United States Patent [19]

Goeke et al.

[11] Patent Number: 4,505,719

[45] Date of Patent: Mar. 19, 1985

[54] PROCESS FOR CLEANING AND COOLING PARTIAL OXIDATION GASES CONTAINING DUST-LIKE POLLUTANTS

[75] Inventors: Eberhard Goeke; Jürgen Ludolph, both of Essen, Fed. Rep. of Germany

[73] Assignee: Krupp Koppers GmbH, Essen, Fed. Rep. of Germany

[21] Appl. No.: 437,906

[22] Filed: Nov. 1, 1982

Related U.S. Application Data

[63] Continuation of Ser. No. 146,174, May 2, 1980, abandoned, which is a continuation of Ser. No. 936,475, Aug. 24, 1978, abandoned.

[30] Foreign Application Priority Data

Sep. 2, 1977 [DE] Fed. Rep. of Germany ..... 2739562

[51] Int. Cl.[3] ..... C10J 3/16

[52] U.S. Cl. ..... 48/202; 55/222

[58] Field of Search ..... 55/89, 94, 222, 228, 55/84, 97, 124, 135, 258, 259, 17; 261/15, 152; 201/4, 26, 29, 30; 48/202, 197 R, 206, 210, 128

[56] References Cited

U.S. PATENT DOCUMENTS

| | | | |
|---|---|---|---|
| 3,473,298 | 10/1969 | Berman | 55/222 |
| 3,963,457 | 6/1976 | Hess | 48/202 |
| 3,971,636 | 7/1976 | Matthews | 48/206 X |
| 3,975,168 | 8/1976 | Gorbaty | 48/202 X |
| 4,065,273 | 12/1977 | Rudolph | 48/206 X |
| 4,211,539 | 7/1980 | Bierbach et al. | 48/206 X |

*Primary Examiner*—Frank Spear

*Attorney, Agent, or Firm*—Michael J. Striker

[57] ABSTRACT

Partial oxidation gases such as formed in a coal gasifier are passed into a mechanical dust separator and prior to their further treatment in a wet cleaner are then passed into a direct cooler where they are cooled to a temperature close to the dewpoint. The gases are thereafter cooled in an indirect cooler to a temperature which is about 5° to 10° C. above the water temperature at the entry into the cooler.

6 Claims, 2 Drawing Figures

PROCESS FOR CLEANING AND COOLING PARTIAL OXIDATION GASES CONTAINING DUST-LIKE POLLUTANTS

This is a continuation of application Ser. No. 146,174, filed May 2, 1980, which is in turn a continuation of application Ser. No. 936,475 filed Aug. 24, 1978.

BACKGROUND OF THE INVENTION

The present invention relates to an improvement of the invention disclosed and claimed in the application filed by Geidies et al. Ser. No. 840,003 on Oct. 6, 1977. In this process, partial oxidation gases which contain dust-like pollutants are first passed into a dust separator where between about 70 to 95% of the pollutants are removed, whereupon the gases are then washed in a wet cleaner with an amount of water which is not larger than is necessary for eliminating the residual dust.

A cooling of the gases between the dust separator and the wet cleaner is provided only optionally in the earlier application. In that case, the gas should be cooled only to the extent that no condensation of steam occurs. The gas, as a consequence of this procedure, when entering the wet cleaner still has a temperature between about 70° and 80° C. corresponding to the dew point of the gas. If no intermediate cooling between the dust separator and the wet cleaner were provided, the temperature of the gases when entering the wet cleaner would even be higher. In the earlier application it is therefore contemplated that the gases which leave the wet cleaner and are largely freed of the dust pollutants are further cooled in a direct cooler by means of circulating water. The circulating water in this case is indirectly cooled.

It is, however, possible that in this procedure, due to the high wash water temperature in the wet cleaner and in the subsequent direct cooler (about 70° C.) deposits may occur in the pipes and channels and a strong vapor may form above the settling basin which is provided for treatment of the discharged wash water.

Besides, the high entry temperature of the gas at the wet cleaner has also been rather undesirable in the earlier process. The reason is that because of the high gas temperature a relatively large gas volume must be processed which in turn requires correspondingly large dimensions of the wet cleaner. This causes the investment and operating cost of the device to be fairly high.

It is therefore an object of the invention to further improve the earlier process by avoiding the just-described difficulties and at the same time to lower the investment and operating cost of the process.

SUMMARY OF THE INVENTION

This is accomplished by cooling the gases which leave the dust separator in a direct cooler prior to the further treatment in the wet cooler. This cooling is effected to a temperature close to the dew point. Subsequently, the gases are cooled in an indirect cooler to a temperature which is about 5° to 10° C. above the entry temperature of the cooling water.

In this process, accordingly, the hot gases which leave the dust separator are first cooled by direct contact with the water to a temperature of about 75° to 85° C. which is close to the dew point. The indirect cooling then follows, down to a temperature of about 25° to 35° C. By suitable design of the indirect cooler it is possible to keep the gas temperature about 5° to 10° C. above the entry temperature of the cooling water.

During the condensation of the steam in the indirect cooler part of the fine dust still entrained in the gas is subjected to wetting and separation. In addition, because of the lower temperature the gas volume ahead of the wet cleaner is only half as large as in the process of the earlier application. For these reasons it is possible to employ a smaller wet cleaner, which results in lower operating and equipment cost.

It is preferred in the process of the invention to unite the dust containing condensate discharged from the indirect and/or direct cooler with the wash water discharged from the wet cleaner and to treat both together in a settling basin. The wash water circulation therefore takes place only at a comparatively low temperature (30° to 50° C.) and the water can be treated in a settling basin of correspondingly smaller dimensions.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILS OF THE INVENTION AND PREFERRED EMBODIMENTS

Figure 1:
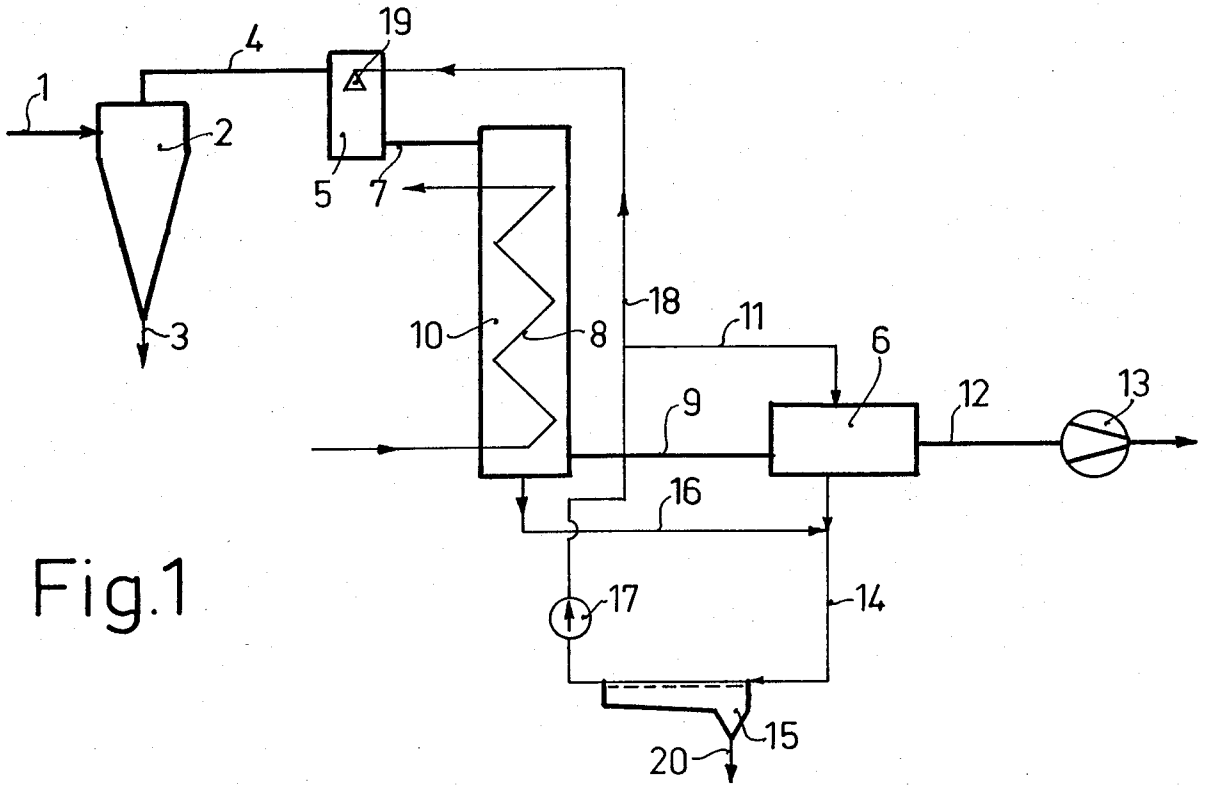
FIG. 1 illustrates a flow sheet for carrying out the process of the invention, in a device in which the direct and indirect cooler are disposed separately from each other.

With reference to FIG. 1, the invention may be illustrated by the cleaning and cooling of a partial oxidation gas such as is produced by the gasifying of coal dust in a Koppers-Totzek gasifier at a pressure of 0.03 atm above atmospheric pressure. This gas contains about 100 g/Nm$^3$ dust-like pollutants, and is first subjected to cooling in a waste heat boiler which is not shown in the flow sheet and which may form a structural unit with the gasifier. This cooling is effected to a temperature of about 300° C.

The gas at this temperature then enters the dust separator 2 through the duct 1. The separator is shown as a cyclone. As has been disclosed in the earlier application, the entry speed of the gas should be between 15 and 25 m/sec. The thus separated dust is withdrawn from the cyclone through the dust 3.

The gas which leaves the top of the cyclone at a temperature of about 295° C. passes through the duct 4 into the direct cooler 5 in which the gas is cooled to a temperature of about 80° C. by injection of water. The gas then flows through the duct piece 7 into the indirect cooler 10 which is provided with a cooling system 8 through which the cooling water circulates. The amount of cooling water and the cooling water circulation can be adjusted relative to the amount of gas, so that the exit temperature of the gas is about 5° to 10° C. above the entry temperature of the cooling water.

After leaving the indirect cooler 10 the gas which now has a temperature of about 30° C. reaches the wet cleaner 6 through the duct 9. The wet cleaner in this case is in the form of a disintegrator. The gas is washed in this cooler with an amount of water which is not larger than necessary for the removal of the residual dust from the gas. Wash water is charged for this purpose through the duct 11 into the wet cleaner 6 in an amount of about 1 liter per $Nm^3$. The purified and cooled gas then leaves the wet cleaner 6 at a temperature of about 30° C. This gas contains at most 15 mg of dust per $Nm^3$ and has the following composition:

| | | | |
|---|---|---|---|
| $CO_2$ | 8.4 Vol. % | Ar | 0.5 Vol. % |
| CO | 63.2 Vol. % | $CH_4$ | 0.1 Vol. % |
| $H_2$ | 26.1 Vol. % | $H_2S$ | 0.8 Vol. % |
| $H_2$ | 0.8 Vol. % | COS | 0.1 Vol. % |

The gas can then be further densified in the densifier 13 as may be required for further processing.

The wash water is discharged from the wet cleaner 6 and contains the dust separated in this step is passed into a settling basin 15 through the duct 14. The dust containing water which condenses from the gas in the indirect cooler 10 is preferably withdrawn through the duct 16, and united with water current in the duct 14, in order to make possible a common purification in the settling basin 15.

This arrangement, in addition, leads to the result that it is not necessary to add additional water into the common wash water circulation for the direct cooler 5 and the wet cleaner 6 as the water which continuously condenses in the indirect cooler 10 is recirculated via the duct 16. The wash water in the duct 14 at the entry into the settling basin 15 has a dust contents of about 6 to 10 grams per liter.

The settling basin 15 may be a conventional device as generally employed for settling of solids from sewage waters. The basin can be in round or longitudinal form. The sludge which settles during the clarifying of the wash water is removed from the process through a duct 20. The wash water that flows out of the settling basin, and which has been freed largely of solids, is again passed by means of a pump 17 and a duct 18 into the direct cooler 5. The wash water is distributed in the direct cooler 5 by means of a spray nozzle 19. If desired, other water feeding means such as distribution trays or rinsing devices may be supplied. A duct 11 is branched off from the duct 16 to obtain the wash water necessary for the wet cleaner 6.

Figure 2:
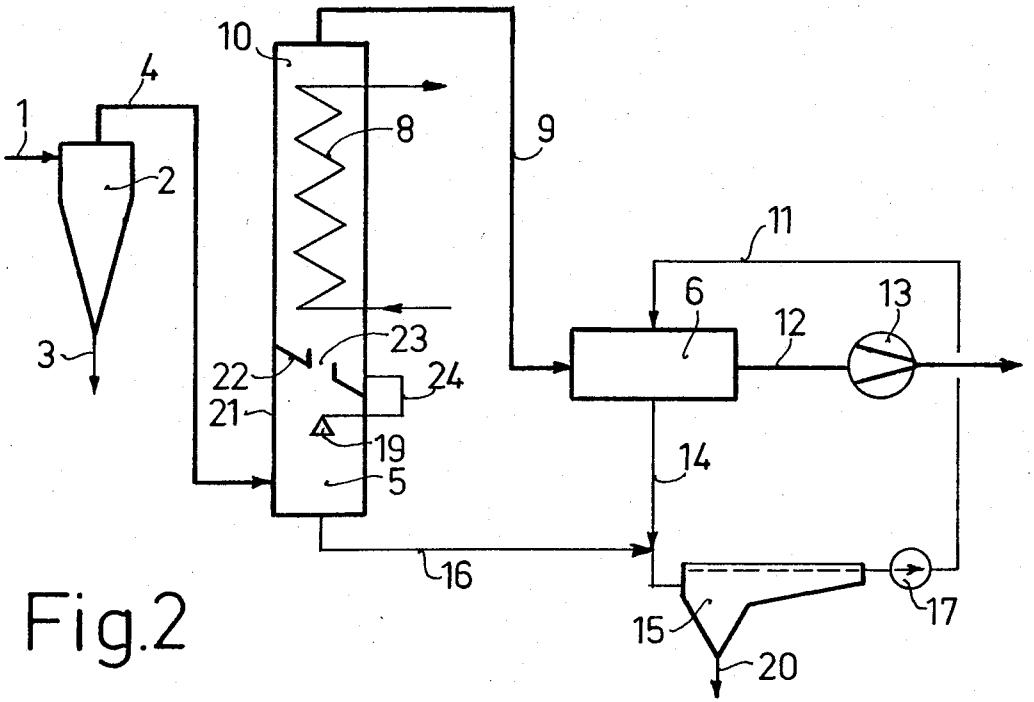
FIG. 2 shows a flow sheet for carrying out the invention, in which process the direct and indirect cooler are united to form a structural unit.

With reference to FIG. 2, it will be seen that the direct cooler 5 and the indirect cooler 10 of the cooling device 21 in this case form a structural unit. The gas which passes through the duct 4 enters the cooling device 21 from the bottom, and first flows through the direct cooler 5 and only thereafter into the superimposed indirect cooler 10. The gas which leaves the cooling device at the top then flows through the duct 9 into the wet cleaner 6, and is there further treated in the above described manner.

The separation between the direct cooler 5 and the indirect cooler 10 is accomplished by a separating wall 22 which is provided with a gas passage 23 so that the gas flow from the bottom towards the top.

The water, i.e. gas condensate, which is separated in the indirect cooler collects on the separating wall 22 and can be withdrawn through the duct 24 or can be sprayed into the gas current in the direct cooler 5 as cooling medium via the spray nozzle 19.

The cooling water which is discharged from the cooling system 8 of the indirect cooler 10 may also be passed into the direct cooler 5, and may there be used to rinse the pipes and/or other structural parts and may serve as cooling medium for the gases.

The water that is discharged from the bottom portion of the cooling device 21 is withdrawn through the duct 16 and united with the water current in the duct 14. Thus, the cleaning of the water from both wet cleaner 6 and cooling device 21 can be effected together in the settling basin 15. The clarified water can then be charged again as necessary into the wet cleaner 6 by means of the pump 17 and the duct 11.

It is noted that otherwise the same reference letters in FIG. 2 have the same meaning as in FIG. 1, making it unnecessary to further explain their function. Regarding the dust separator 2 and the wet cleaner 6, the requirements are the same as in the earlier application. This means that as dust cleaner there may preferably be used cyclones of conventional structure, provided that the gas entry speed is in the range between 15 and 25 m/sec. in order to obtain the necessary degree of separation.

However, it is also possible to use so-called gravity separators or impact separators. As wet cleaners, there are preferably used the abovementioned disintegrators, but other types of wet dust separators may also be employed.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In the process of cleaning and cooling partial oxidation gases which are produced by gasification of coal dust in a Koppers-Totzek gasifier (entrained-bed gasifier) in which process the hot gases are passed to a mechanical dust separator where about 70 to 95% of the pollutants are eliminated and the gases are then washed in a wet cleaner with water in an amount not greater than is required to eliminate the residual dust; the improvement of cooling the gases leaving the dust separator in a direct cooler to a temperature of about 75°-85° C., close to the dew point thereof but only to the extent that no condensation of steam takes place, thereafter further cooling the gases in an indirect cooler to a temperature which is 5° to 10° C. above the temperature of the cooling water at its entry into the indirect cooler, and then introducing said cooled gases into the wet cleaner for further treatment therein.

2. The process of claim 1 wherein the direct cooler and the wet cleaner are interconnected by a common wash water circulation which also includes a settling basin.

3. The process of claim 1 wherein a cooling device is used in which the direct and the indirect cooler are superimposed and form one structural unit.

4. The process of claim 1 wherein the direct cooler is charged with the gas condensate discharged from the indirect cooler.

5. The process of claim 1 wherein the cooling water discharged from the indirect cooler is used for rinsing the pipes and/or other structural parts of the direct cooler.

6. The process of claim 1 wherein the condensate which is discharged from the indirect and/or direct cooler is united with the wash water which is discharged from the wet cleaner and wherein all of the water is then passed into a settling basin.

* * * * *